United States Patent [19]

Hinata et al.

[11] 3,977,883

[45] Aug. 31, 1976

[54] SPECTRALLY SENSITIZED SILVER HALIDE PHOTOGRAPHIC EMULSION

[75] Inventors: Masanao Hinata; Haruo Takei; Akira Sato; Atsuo Iwamoto, all of Minami-ashigara, Japan

[73] Assignee: Fuji Photo Film Co., Ltd., Minami-ashigara, Japan

[22] Filed: Dec. 6, 1974

[21] Appl. No.: 530,101

[30] Foreign Application Priority Data

Dec. 6, 1973 Japan ..... 48-138343

[52] U.S. Cl. ..... 96/124; 96/131; 96/132; 96/137

[51] Int. Cl.[2] ..... G03C 1/14

[58] Field of Search ..... 96/124, 137, 131

[56] References Cited

UNITED STATES PATENTS

| | | | |
|---|---|---|---|
| 3,667,960 | 6/1972 | Shiba et al. | 96/124 |
| 3,745,014 | 7/1973 | Nakazawa et al. | 96/124 |

*Primary Examiner*—J. Travis Brown

*Attorney, Agent, or Firm*—Sughrue, Rothwell, Mion, Zinn and Macpeak

[57] ABSTRACT

A silver halide photographic emulsion containing, in combination, supersensitizing amounts of at least one sensitizing dye of the following general formula (I)

(I)

wherein $Z_1$ and $Z_2$ each represents an atomic group required to form a quinoline ring; $R_1$ and $R_2$ each represents an aliphatic group, with at least one of $R_1$ and $R_2$ being a hydroxyalkyl group, an alkyl group containing a carboxyl group or an alkyl group containing a sulfo group; $X_1$ is an acid anion; and $m$ is 1 or 2, and when $m$ is 1 the dye forms an intramolecular salt and at least one sensitizing dye of the following general formula (II)

(II)

wherein $Z_3$ represents an atomic group required to form a benzimidazole ring, a benzoxazole ring or a $\beta$-naphthoxazole ring; $Z_4$ represents an atomic group required to form a benzothiazole ring, a benzoselenazole ring, a $\beta$-naphthothiazole ring or a $\beta$-naphthoselenazole ring; $R_3$ and $R_4$ each represents an aliphatic group with at least one of $R_3$ and $R_4$ being an alkyl group containing a carboxyl group, a hydroxyalkyl group or an alkyl group containing a sulfo group; $R_5$ represents a hydrogen atom or an alkyl group; $X_2$ is an acid anion group; and $n$ is 1 or 2, and when $n$ is 1 the dye forms an intramolecular salt.

7 Claims, 6 Drawing Figures

SPECTRALLY SENSITIZED SILVER HALIDE PHOTOGRAPHIC EMULSION

BACKGROUND OF THE INVENTION

1. Field of the Invention

This invention relates to a silver halide photographic emulsion spectrally sensitized with at least two sensitizing dyes having supersensitizing effects on each other, and more specifically, to a silver halide photographic emulsion having increased spectral sensitivity in the red wavelength region.

2. Description of the Prior Art

One well-known technique of producing photographic materials is a spectrally sensitizing process by which the wavelength region to which a silver halide photographic emulsion is sensitive is broadened to a longer wavelength region by adding a certain kind of cyanine dye. It is generally known that the spectral sensitivity of a silver halide photographic emulsion is affected by the chemical structure of the sensitizing dye and the various characteristics of the emulsion such as the halogen composition of the silver halide, the crystal habit, the crystal system, the silver ion concentration or the hydrogen ion concentration, and also by photographic additives present in the emulsion, such as stabilizers, anti-foggants, coating assistants, precipitating agents, or color couplers.

Generally, only one sensitizing dye is used to sensitize a photographic material to a specific spectral wavelength region. When such sensitizing dyes are used in combination, the sensitivity obtained is often lower than that obtained by using each of the sensitizing dyes individually. However, in some special cases, the spectral sensitivity obtained using a combination of two or more sensitizing dyes makedly increases. This type of sensitization is known as "supersensitization". However, precise selection of sensitizing dyes to be used in combination must be made since a seemingly slight difference in chemical structure can markedly affect the supersensitization of the dyes employed. Accordingly, appropriate combinations of sensitizing dyes having supersensitizing effects are difficult to predict from consideration of their chemical structural formula only.

Generally, the sensitizing effect of a dye on a certain emulsion can be varied by changing the emulsion characteristics. For example, the sensitizing effect can be increased by increasing the silver ion concentration, or by decreasing the hydrogen ion concentration, or by employing both of these techniques. The sensitizing effect can, therefore, be increased by immersing a film coated with the spectrally sensitized emulsion in water or an aqueous solution of ammonia. The above method by which the sensitivity of a sensitized emulsion is changed by increasing the silver ion concentration or decreasing the hydrogen ion concentration or by both is usually called "hypersensitization". Hypersensitized emulsions generally have a short storage life.

When sensitization is applied to a silver halide photographic emulsion, the sensitizing dyes must not have adverse interactions with photographic additives other than the sensitizing dyes, and stable photographic characteristics must be maintained even during the storage of the photographic materials. A further requirement of the sensitizing dyes used is that no "residual coloration" due to the sensitizing dyes in the processed photographic materials must remain. This requirement is especially important when processing the photographic materials rapidly within a short period of time (usually several seconds to up to about 1 minute).

In order to obtain excellent color reproducibility of a color photographic material, the red sensitive layer preferably does not have a high sensitivity at too long a wavelength, for example, at wavelengths longer than 600 nm (the wavelength at which sensitization is maximum), or have a sensitivity at too short a wavelength, for example, at wavelengths shorter than 580 nm (at which sensitization is maximum). According to spectrally sensitizing techniques, it is difficult to increase sensitivity in the wavelength region not exceeding about 630 nm (the wavelength at which sensitization is maximum). Among all, it is particularly difficult to increase the sensitivity in the wavelength region ranging from about 580 to 600 nm, and therefore, to solve this problem is one of the important subjects in the art.

SUMMARY OF THE INVENTION

Accordingly, a primary object of this invention is to provide a spectrally sensitized silver halide photographic emulsion which has an especially high sensitivity in the wavelength region described above and which has reduced residual coloration after processing.

A second object of this invention is to provide a color photographic emulsion, in which the decrease of the sensitivity generally occurring when a spectrally sensitizing dye and a cyan coupler are used in combination is reduced.

A third object of this invention is to provide a multilayered photographic emulsion in which adjacent photographic layers are not sensitized by the diffusion of a spectrally sensitizing dye.

A fourth object of this invention is to provide a photographic emulsion, in which the decrease in sensitivity generally occurring during the passage of time from the production of the photographic material is reduced.

These objects are achieved with a silver halide photographic emulsion containing, in combination, supersensitizing amounts of at least one sensitizing dye of the general formula (I)

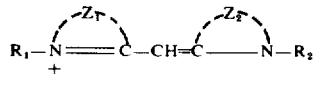

(I)

wherein $Z_1$ and $Z_2$ each represents an atomic group required to form a quinoline ring which can be substituted with a substituent that does not deteriorate the sensitivity, for example, an alkyl group, e.g., having 1 to 4 carbon atoms such as a methyl or ethyl group, an alkoxy group, e.g., having 1 to 4 carbon atoms, such as a methoxy group, a hydroxyl group, or a halogen atom such as a chlorine or bromine atom; $R_1$ and $R_2$ each represents a saturated or unsaturated aliphatic group, at least one of which is a hydroxyalkyl group, an alkyl group containing a carboxyl group, or an alkyl group containing a sulfo group; $X_1$ represents an acid anion; and $m$ is 1 or 2, when $m$ is 1 the dye forms an intramolecular salt (a betaine-like structure); and at least one sensitizing dye of the general formula (II)

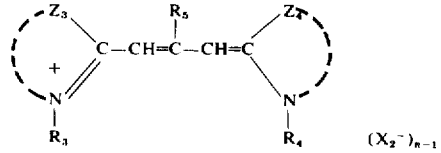

(II)

wherein $Z_3$ represents an atomic group required to form a benzimidazole ring, a benzoxazole ring or a β-naphthoxazole ring, which can be substituted with a substituent that does not deteriorate the sensitivity, for example, an alkyl group, e.g., having 1 to 4 carbon atoms such as a methyl or trifluoromethyl group, an alkoxy group, e.g., having 1 to 4 carbon atoms in the alkyl moiety thereof such as a methoxy group, a carbamoyl group such as an unsubstituted carbamoyl group or an alkyl(e.g., having 1 to 4 carbon atoms in the alkyl moiety thereof such as a methyl- or ethyl-substituted) carbamoyl group, a carboxyl group, a carboxyalkyl group, e.g., having 1 to 4 carbon atoms in the alkyl moiety thereof such as a carboxymethyl group, an alkoxycarbonyl group, e.g., having 1 to 4 carbon atoms in the alkyl moiety thereof such as a methoxycarbonyl group, an aryl group such as a phenyl group, or a halogen atom such as a chlorine, bromine or fluorine atom; $Z_4$ represents an atomic group required to form a benzothiazole ring, a benzoselenazole ring, or a β-naphthoselenazole ring, which can be substituted with a substituent that does not deteriorate the sensitivity, for example, an alkyl group, e.g., having 1 to 4 carbon atoms such as a methyl or trifluoromethyl group, an alkoxy group, e.g., having 1 to 4 carbon atoms in the alkyl moiety thereof such as a methoxy group, an alkoxycarbonyl group, e.g., having 1 to 4 carbon atoms in the alkoxy moiety thereof such as a methoxycarbonyl group, a carboxyl group, a hydroxyl group, a cyano group, an acyl group such as an acetyl or benzoyl group, a carbamoyl group such as an unsubstituted carbamoyl group, or an alkyl(e.g., having 1 to 4 carbon atoms in the alkyl moiety thereof, such as methyl- or ethyl-substituted)carbamoyl group, or a halogen atom such as a chlorine, bromine or fluorine atom; $R_3$ and $R_4$ each represents a saturated or unsaturated aliphatic group, at least one of which is an alkyl group containing a carboxyl group, a hydroxyalkyl group or an alkyl group containing a sulfo group; $R_5$ represents a hydrogen atom or an alkyl group, e.g., having 1 to 4 carbon atoms; $X_2$ represents an acid anion; and $n$ is 1 or 2, and when $n$ is 1 the dye forms an intramolecular salt.

DETAILED DESCRIPTION OF THE INVENTION

Figure 1:
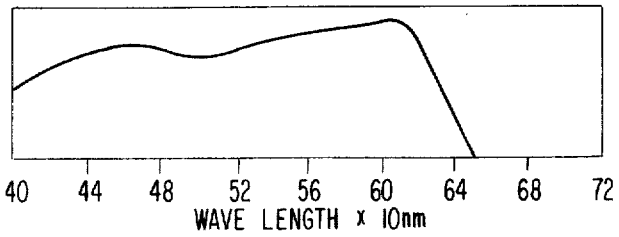
FIGS. 1 to 5 show the spectral sensitivity curves obtained in Runs Nos. 1, 3, 4, 6 and 9 in the Example.

Examples of heterocyclic rings formed by $Z_1$ and $Z_2$ in the general formula (I) are quinoline, 6-methylquinoline, 6-ethylquinoline, 6-methoxyquinoline, 6-ethoxyquinoline, 6-hydroxyquinoline, 6-chloroquinoline, and 6-bromoquinoline rings.

Examples of heterocyclic rings formed by $Z_3$ in the general formula (II) include benzimidazole rings substituted at the 1-position with an alkyl group such as a methyl, ethyl or propyl group or a substituted alkyl group such as a hydroxyalkyl or acetoxyalkyl group, an allyl group or an aryl group such as a phenyl group, specifically 1-methylbenzimidazole, 1-ethylbenzimidazole, 1-methyl-5-chlorobenzimidazole, 1-methyl-5-fluorobenzimidazole, 1-methyl-5,6-dichlorobenzimidazole, 1-methyl-5,6-difluurobenzimidazole, 1-ethyl-5-chlorobenzimidazole, 1-ethyl-5-fluorobenzimidazole, 1-ethyl-5,6-dichlorobenzimidazole, 1-ethyl-5,6-difluorobenzimidazole, 1-propyl-5-chlorobenzimidazole, 1-propyl-5-fluorobenzimidazole, 1-propyl-5,6-dichlorobenzimidazole, 1-propyl-5,6-difluorobenzimidazole, 1-allyl-5-chlorobenzimidazole, 1-allyl-5-fluorobenzimidazole, 1-allyl-5,6-dichlorobenzimidazole, 1-allyl-5,6-difluorobenzimidazole, 1-phenyl-5-chlorobenzimidazole, 1-phenyl-5-fluorobenzimidazole, 1-phenyl-5,6-dichlorobenzimidazole, and 1-phenyl-5,6-difluorobenzimidazole rings, and benzoxazole, 5-fluorobenzoxazole, 5-chlorobenzoxazole, 5-bromobenzoxazole, 5-trifluoromethylbenzoxazole, 5-methylbenzoxazole, 5,6-dimethylbenzoxazole, 5-methoxybenzoxazole, 5,6-dimethoxybenzoxazole, 5-carboxybenzoxazole, 5-carboxymethylbenzoxazole, and β-naphthoxazole rings.

Examples of heterocyclic rings formed by $Z_4$ in the general formula (II) include benzothiazole, 5-chlorobenzothiazole, 5-bromobenzothiazole, 5-fluorobenzothiazole, 5-methylbenzothiazole, 5-methoxybenzothiazole, 5-methylcarbonylbenzothiazole, 5-methoxycarbonylbenzothiazole, 5-hydroxybenzothiazole, 5-trifluoromethylbenzothiazole, 5-cyanobenzothiazole, 5,6-dimethylbenzothiazole, 5,6-dimethoxybenzothiazole, 5,6-dichlorobenzothiazole, β-naphthothiazole, benzoselenazole, 5-chlorobenzoselenazole, 5-bromobenzoselenazole, 5-methylbenzoselenazole, 5-methoxybenzoselenazole, 5,6-dimethylbenzoselenazole, and β-naphthoselenazole rings.

$R_1$, $R_2$, $R_3$ and $R_4$ each represents, for example, an unsubstituted alkyl group e.g., having 1 to 4 carbon atoms such as a methyl, ethyl or propyl group, a substituted alkyl group e.g., having 1 to 8 carbon atoms and 1 to 4 carbon atoms in the alkyl-moiety thereof such as a hydroxyalkyl group (e.g., a 2-hydroxyethyl or 3-hydroxypropyl group), a carboxy-containing alkyl group such as a carboxyalkyl group (e.g., a 2-carboxyethyl, 3-carboxypropyl or 4-carboxybutyl group), a carboxyalkoxy-substituted alkyl group (e.g., a 2-(2-carboxyethoxy)ethyl group), a sulfo-containing alkyl group such as a sulfoalkyl group (e.g., a 2-sulfoethyl, 3-sulfoproptyl or 3-sulfobutyl group), a sulfoalkoxy-substituted alkyl group (e.g., a 2-(3-sulfopropoxy)ethyl or 3-sulfopropoxyethoxyethyl group), a sulfo-hydroxy-substituted alkyl group (e.g., a 2-hydroxy-3-sulfopropyl group), or a vinylmethyl group.

$R_5$ represents, for example, a hydrogen atom, or an alkyl group such as a methyl, ethyl or propyl group.

$X_1$ and $X_2$ each represents an acid anion used for conventional cyanine dye salts, such as an iodide, a bromide, a chloride, a p-toluenesulfonate, a benzenesulfonate, a sulfate, a perchlorate ion, or a thiocyanate ion.

The sensitizing dyes of the general formula (I) have a sensitization maximum at about 580 nm, and many of these dyes have a low spectral sensitivity. On the other hand, the carbocyanine dyes of the general formula (II) have a sensitization maximum at about 590 to 610 nm, and have a high spectral sensitivity.

By using the sensitizing dyes of the generals formulas (I) and (II) together, the sensitivity in the red wavelength region, especially at about 580 to 600 nm, of the sensitizing dyes of the general formula (II) can be greatly increased.

The supersensitizing technique in accordance with this invention is useful for producing emulsions for coupler-incorporated color photographic materials of a multilayered structure, particularly emulsions for reversal color or negative color films or micronegative color films.

Some specific examples of the sensitizing dyes which can be used in this invention are given below. It should be understood however that the invention is not to be interpreted as being limited to these specific examples.

Examples of the dyes of the general formula (I) includes the following dyes.

(I - A)

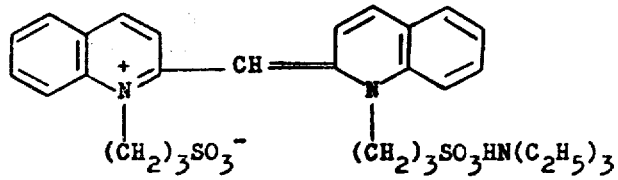

(I - B)

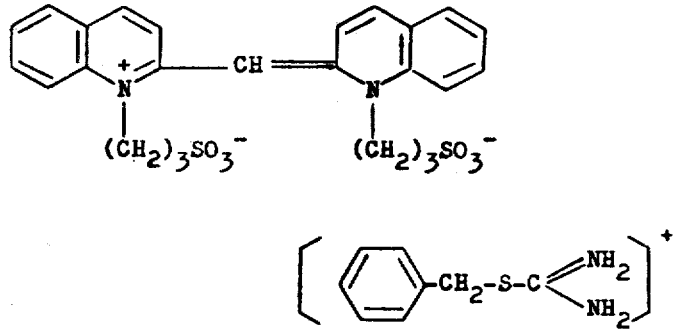

(I - C)

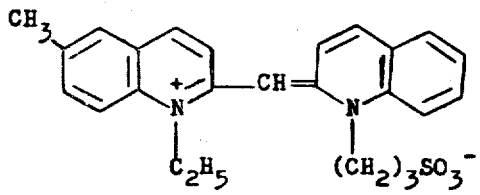

(I - D)

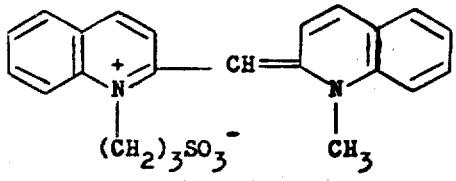

(I - E)

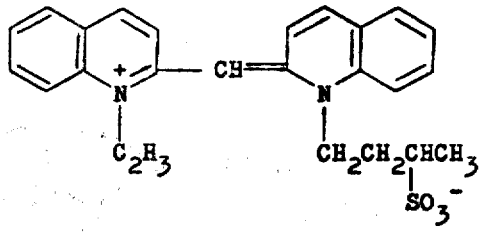

-continued
(I - F)
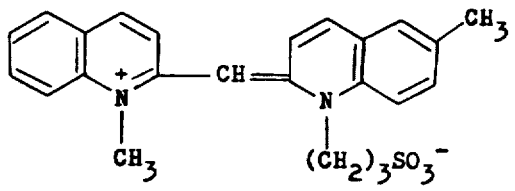
(I - G)
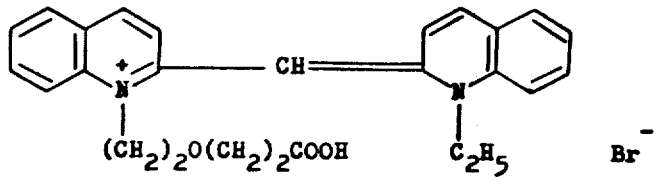
(I - H)
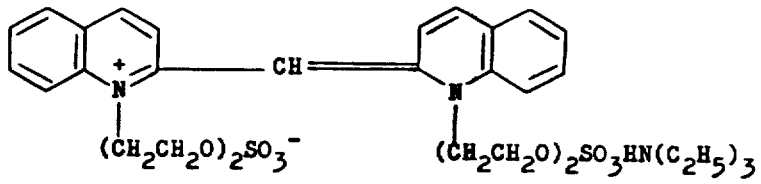
(I - I)
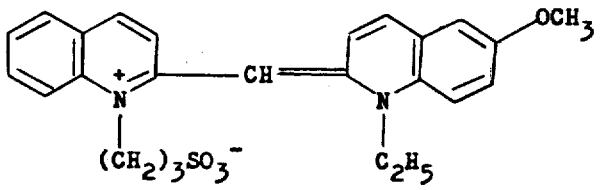
Examples of the dyes of the general formula (II) include the following dyes.
(II - A)
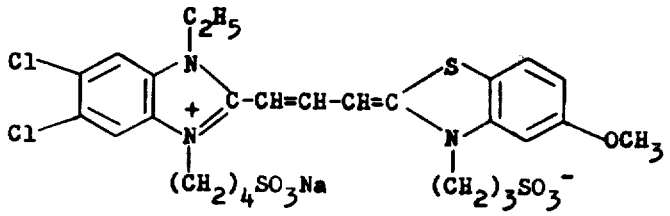
(II - B)
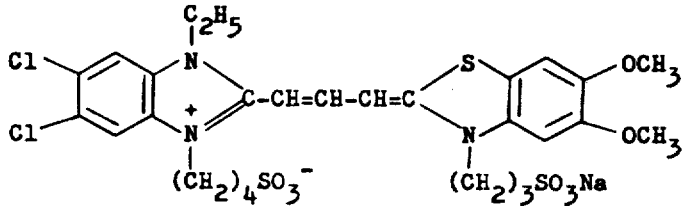

-continued
(II - C)
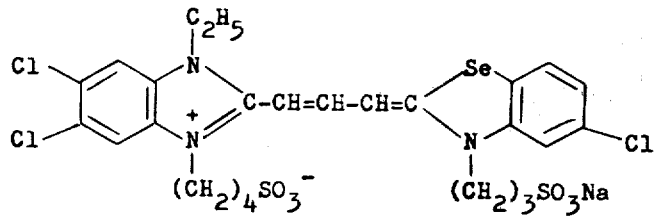
(II - D)
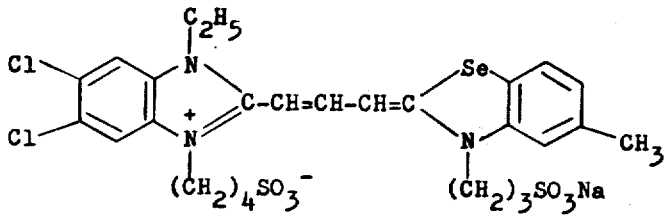
(II - E)
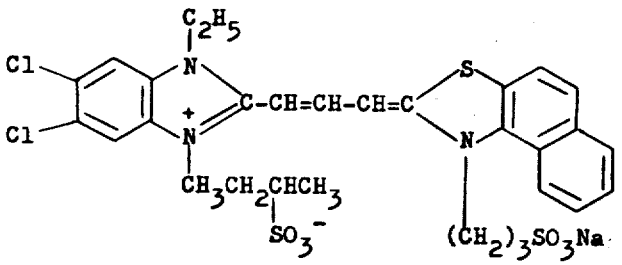
(II - F)
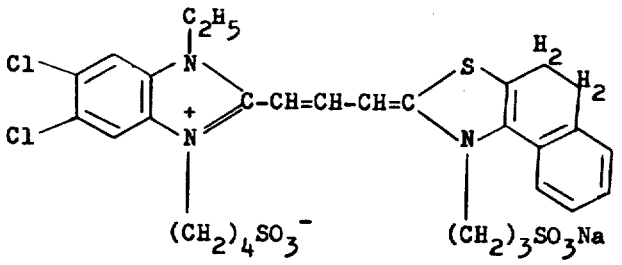
(II - G)
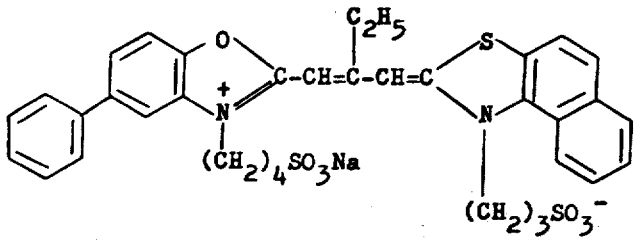

-continued
(II - H)
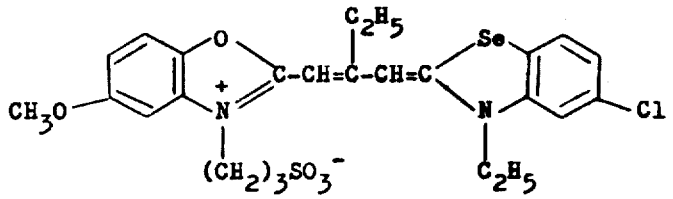
(II - I)
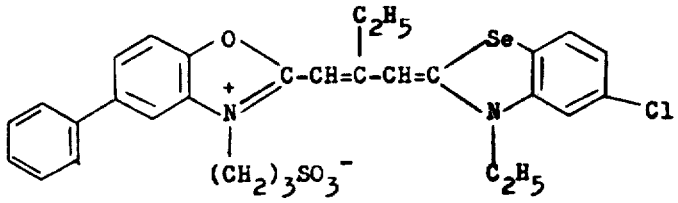
(II - J)
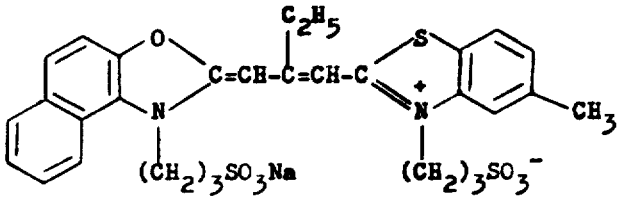
(II - K)
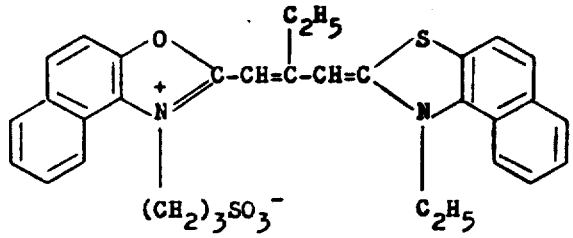
(II - L)
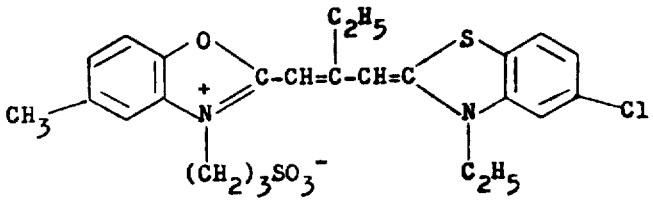
(II - M)
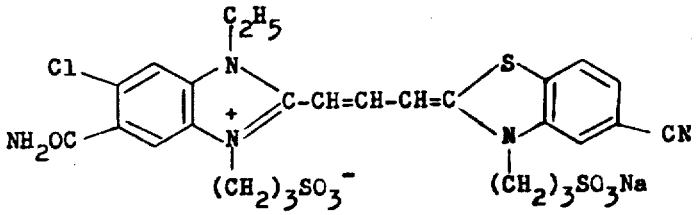

-continued (II - N)

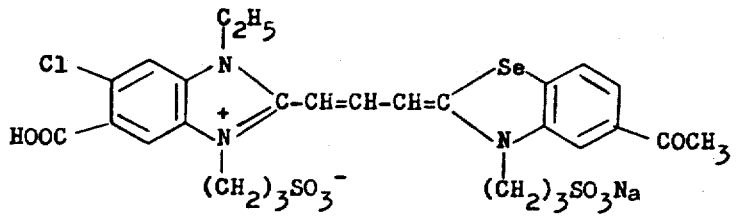

(II - O)

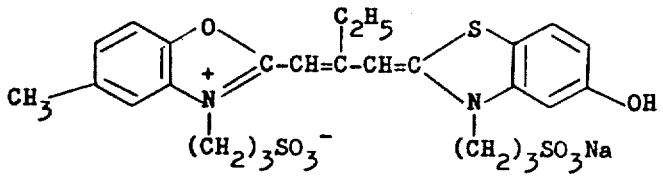

(II - P)

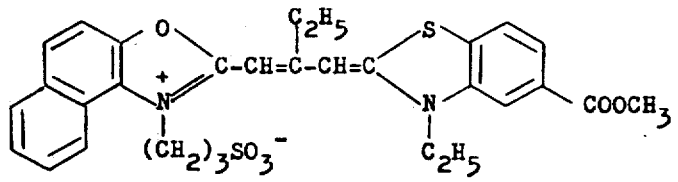

The silver halide photographic emulsion of this invention can be produced using conventional techniques, and can contain silver chloride, silver bromide, silver iodide or mixed silver halide grains prepared, for example, using a single jet process, a double jet process or a combination of these processes. A preferred silver halide is silver iodobromide or silver chloroiodo bromide (preferably containing not more than about 10 mol% of iodide). The particle size of the silver halide can be either an ordinary particle size or a fine particle size, but silver halide grains having an average diameter (measured, for example, by the projected area method and expressed as a number average) of about 0.04 $\mu$ to 2 $\mu$ are preferred.

The silver halide photographic emulsion of this invention can be sensitized using conventional chemical sensitizing techniques, such as by sensitization with gold (for example, as described in U.S. Pat. Nos. 2,540,085, 2,597,856, 2,597,915, and 2,399,083), sensitization with Group VIII metal ions, sensitization with sulfur (for example, as described in U.S. Pat. Nos. 1,574,944, 2,278,947, 2,449,206, 2,410,689, 3,189,458, and 3,415,649), and reduction sensitization (for example, as described in U.S. Pat. Nos. 2,518,698, 2,419,974, and 2,983,610), either alone or in combination.

Specifically, the silver halide photographic emulsion of this invention can contain a sulfur sensitizing agent such as allylthiocarbamide, thiourea, sodium thiosulfate or cystine, a noble metal sensitizing agent such as potassium chloroaurate, aurous thiosulfate or potassium chloropalladate, a reducing sensitizing agent such as stannous chloride, phenyl hydrazine or reductone, or a sensitizer such as a polyoxyethylene compound, a polyoxypropylene compound or a compound containing a quaternary ammonium group.

The emulsion can also contain an antifogging agent such as nitrobenzimidazole, or ammonium chloroplatinate, a stabilizer such as 4-hydroxy-6-methyl-1,3,3a,7-tetrazaindene, a hardening agent such as formaldehyde, chrom alum, 1-hydroxy-3,5-dichlorotriazine sodium salt, glyoxal, or dichloroacrolein, or a coating assistant such as saponin or a sodium alkylbenzenesulfonate.

When used in a color photographic material, the silver halide photographic emulsion of this invention can contain a color coupler and a dispersing agent for the color coupler.

Of the color couplers, cyan couplers are especially preferred. For example, the phenolic couplers disclosed in U.S. Pat. No. 2,698,794 or the naphthol-type couplers disclosed in U.S. Pat. No. 2,474,293 are especially useful.

The couplers disclosed in U.S. Pat. Nos. 2,600,788 and 3,062,653 or Japanese Patent Publication No. 6031/65, or the $\alpha$-naphthol-type cyan couplers or phenolic cyan couplers disclosed, for example, in U.S. Pat. Nos. 3,311,476, 3,458,315, 3,214,437, and 3,253,924 can also be used.

Typical examples of colored couplers are those couplers disclosed in Japanese Patent Publication No. 2016/69, U.S. patent application Ser. No. 462,842, filed Apr. 22, 1974; and U.S. Pat. Nos. 3,476,560, 3,034,892, 3,386,301, 2,434,272 and 3,476,564.

Typical examples of DIR couplers are those disclosed in U.S. Pat. Nos. 3,148,062, 3,227,554, 3,701,783, 3,617,291, 3,622,328, 3,770,436 and 3,790,384, and Japanese Patent Publication No. 33233/70.

The silver halide photographic emulsion used in this invention can contain a protective colloid such as gelatin, an acylated gelatin (e.g., phthaloylated gelatin or malonated gelatin), a cellulose compound (e.g., hydroxyethyl cellulose or carboxymethyl cellulose), a soluble starch (e.g., dextrin) or a hydrophilic polymer (e.g., polyvinyl alcohol, polyvinyl pyrrolidone, polyacrylamide, or polystyrene sulfonic acid), a plasticizer for dimensional stability, a latex polymer, or a matting agent. The finished emulsion is coated on a suitable support, for example, baryta paper, a resin-coated paper, synthetic paper-like sheet, a cellulose triacetate film, a polyethylene terephthalate film, a glass sheet, or other plastic bases. A suitable coating amount of the silver halide emulsion can range from $10^{-3}$ mol to $10^{-1}$ mole of silver halide per $m^2$ of the support.

The sensitizing dyes used in this invention can be added as aqueous solutions or solutions in a water-miscible organic solvent such as methanol, ethanol, methyl cellosolve or pyridine.

The amounts of the sensitizing dyes employed are those amounts usually suitable for supersensitization, for example, $5 \times 10^{-3}$ mol to $1 \times 10^{-6}$ mol of each of the sensitizing dyes per mol of silver. A preferred molar ratio of the dye of formula (II) to the dye of formula (I) is about 1:10 to 1:1.

The combination of the supersensitizing dyes in accordance with this invention can be used for sensitizing various silver halide photographic emulsions for color and black-white photographic materials. The emulsions of this invention can be, for example, color positive emulsions, color paper emulsions, color negative emulsions, color reversal emulsions (with or without couplers), emulsions for photograhic materials for the graphic arts (for example, lithographic films), emulsions for cathode ray tube display recording photographic materials, emulsions for X-ray recording photographic materials (materials used for direct and indirect X-ray photography using an intensifying screen), emulsions for the colloid transfer process disclosed, for example, in U.S. Pat. No. 2,716,059), emulsions for the silver salt diffusion transfer process (for example, as disclosed in U.S. Pat. Nos. 2,352,014, 2,543,181, 3,020,155, and 2,861,885) emulsions for the color diffusion transfer process (for example, as disclosed in U.S. Pat. Nos. 3,087,817, 3,185,567, 2,983,606, 3,253,915, 3,227,550, 3,227,551, 3,227,552, 3,415,644, 3,415,645, and 3,415,646), emulsions for the dye transfer process or imbibition transfer process as disclosed, for example, in U.S. Pat. No. 2,882,156), emulsions for the silver dye bleaching method (as described in Friedman, *History of Color Photography*, American Photographic Publishers, Co., 1944, especially Chapter 24), emulsions for materials for recording print-out images as disclosed, for example, in U.S. Pat. No. 2,369,449 and Belgian Pat. No. 704,255), emulsions for direct print image photographic materials (for example, as disclosed in U.S. Pat. Nos. 3,033,682 and 3,287,137), emulsions for heat developable photographic materials (for example, as disclosed in U.S. Pat. Nos. 3,152,904, 3,312,550, and 3,148,122, and British Pat. No. 1,110,046), and emulsions for physical development photographic materials (for example, as disclosed in British Pat. Nos. 920,277 and 1,131,238).

Furthermmore, the dyes in accordance with the present invention can be used for spectral sensitization using the methods disclosed in German Patent OLS No. 2,104,283 patent U.S. Pat. No. 3,649,286.

The following Example is given to illustrate the present invention in detail, but the invention is not to be construed as being limited to this Example. Unless otherwise indicated, all parts, percents, ratios and the like are by weight.

EXAMPLE

A silver iodobromide (iodide content: 7 mol%) was prepared by precipitating silver halide grains using a conventional double jet process, and by physically ripening, desalting and chemically ripening the silver halide grains according to a conventional method disclosed in P. Glafkides, *Chimie et Physique Photographiques*, pp. 367–443, 1957.

The silver halide grains contained in this emulsion had an average diameter of 0.7 micron. One kilogram of this emulsion contained 0.52 mol of the silver halide. One kilogram of the emulsion was weighed and placed in a pot, and immersed in a constant temperature bath at 50°C to melt the emulsion.

Predetermined amounts of methanol solutions of each of the sensitizing dyes of this invention and methanol solutions of sensitizing dyes for comparison were added as shown in Table 1, and mixed respectively with the silver halide emulsion at 40°C with stirring to prepare emulsions. To each of the emulsions were further added 10 cc of a 0.1% by weight aqueous solution of 4-hydroxy-6-methyl-1,3,3a,7-tetrazaindene, 10 cc of a 1% by weight aqueous solution of 1-hydroxy-3,5-dichlorotriazine sodium salt, and 10 cc of a 1% by weight aqueous solution of sodium dodecylbenzenesulfonate, and the mixture was stirred. Each of the finished emulsions was coated on a cellulose triacetate film support in a dry coating thickness of 5 microns, and dried to form a sample of a photographic material. Each film sample was then cut into strips.

One of the strips was exposed through an optical wedge using a sensitometer having a light source with a color temperature of 5400°K to which were attached a blue filter (Sp-1) and a red filter (Sc-56) (products of Fuji Photo Film Co., Ltd.).

Another strip was exposed using a diffraction grating type spectral photographic camera having a tungsten light source with a color temperature of 2,666°K in order to obtain a spectrogram.

Still another strip was exposed through an optical wedge using a diffraction grating-type strong Monochromater -Shimazu-Bausch and Lomb, a product of Shimazu Seisakusho Co., Ltd.) in order to obtain the sensitivity to monochromatic light at 580 nm.

Each of the strips was developed for 2 minutes at 20°C using a developer solution comprising 500 ml of water, 2,2 g of Metol, 96.0 g of anhydrous sodium sulfite, 8.8 g of hydroquinone, 56.0 g of sodium carbonate monohydrate, 5.0 g of potassium bromide, and additional water to make 1 liter, and then stopped, fixed and rinsed to obtain strips having black-and-white images. The densities of these photographs were measured using an S-type densitomer (a product of Fuji Photo Film Co., Ltd.) to determine the blue filter sensitivity (SB), the red filter sensitivity (SR), the monochromatic spectral sensitivity at 580 nm (S 580), and fog. The standard point of optical density for determining the sensitivities was the point of (fog + 0.2). The results obtained are shown in Tables 1 to 7 as relative values.

The effect obtained by the combination of the sensitizing dyes in accordance with this invention is not all impaired even when these sensitizing dyes are further combined with a red-sensitive sensitizing dye or oxacarbocyanine dye (that is, the combination of the sensitizing dyes of formulae (I) and (II) with a red-sensitive sensitizing dye or oxacarbocyanine dye).

The red-sensitive dyes which can be used in combination with the sensitizing dyes used in this invention can, for example, be expressed by the following general formula (III)

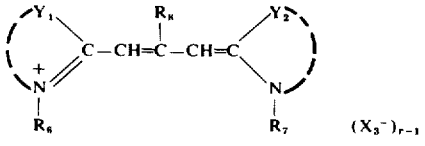

(III)

wherein $Y_1$ and $Y_2$ each represents an atomic group required to form a benzothiazole ring, a benzoselenazole ring or a naphthothiazole ring, which can be substituted with a substituent that does not deteriorate the sensitivity (for example, the substituents described with respect to the general formulae (I) and (II); $R_6$ and $R_7$ each represents an aliphatic group (for example, those described with respect to $R_1$ to $R_4$ in the general formulae (I) and (II) at least one of which is preferably a sulfo-containing alkyl group, a carboxy-containing alkyl group or a hydroxyalkyl group; $R_8$ is a lower alkyl group such as a methyl or ethyl group or an aryl group such as a phenyl group; and $X_3$ and $r$ are the same as $X_1$ and $m$ respectively, in the general formula (I).

Some specific examples of these red-sensitive dyes are given below.

(A)

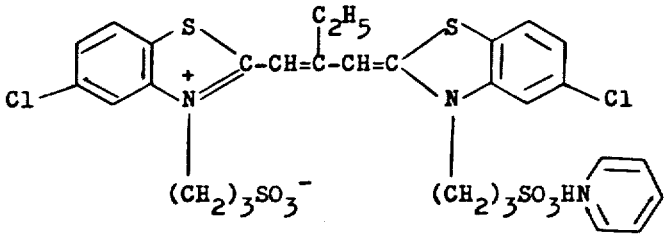

(B)

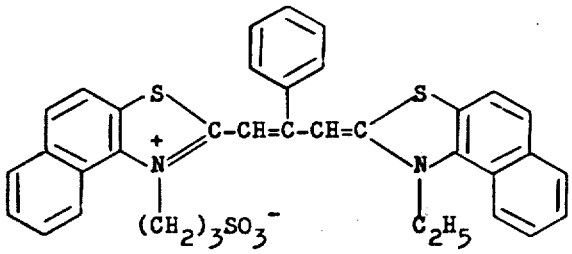

(C)

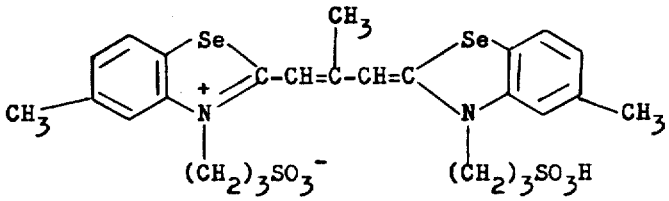

-continued ( D )

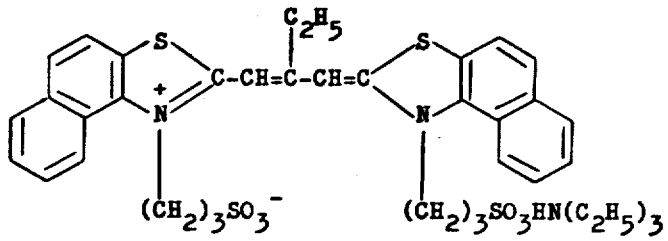

( E )

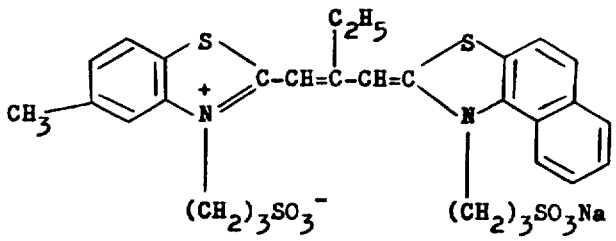

Table 1

Figure 2:
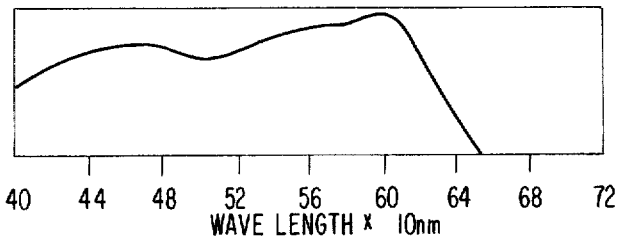
Figure 3:
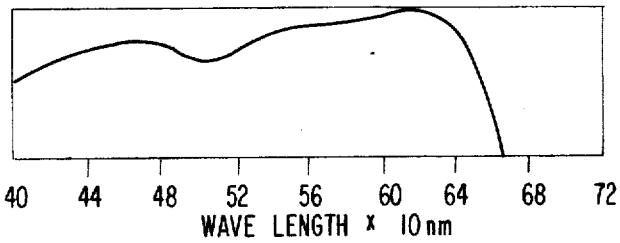
Figure 4:
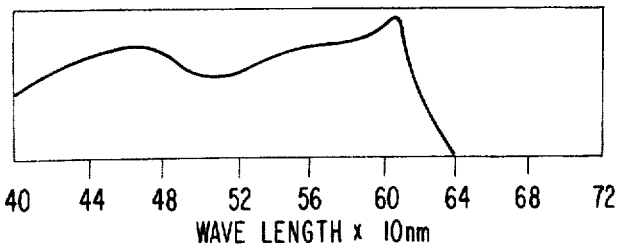
Figure 5:
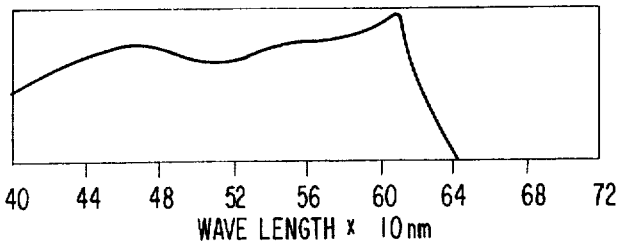
Figure 6:
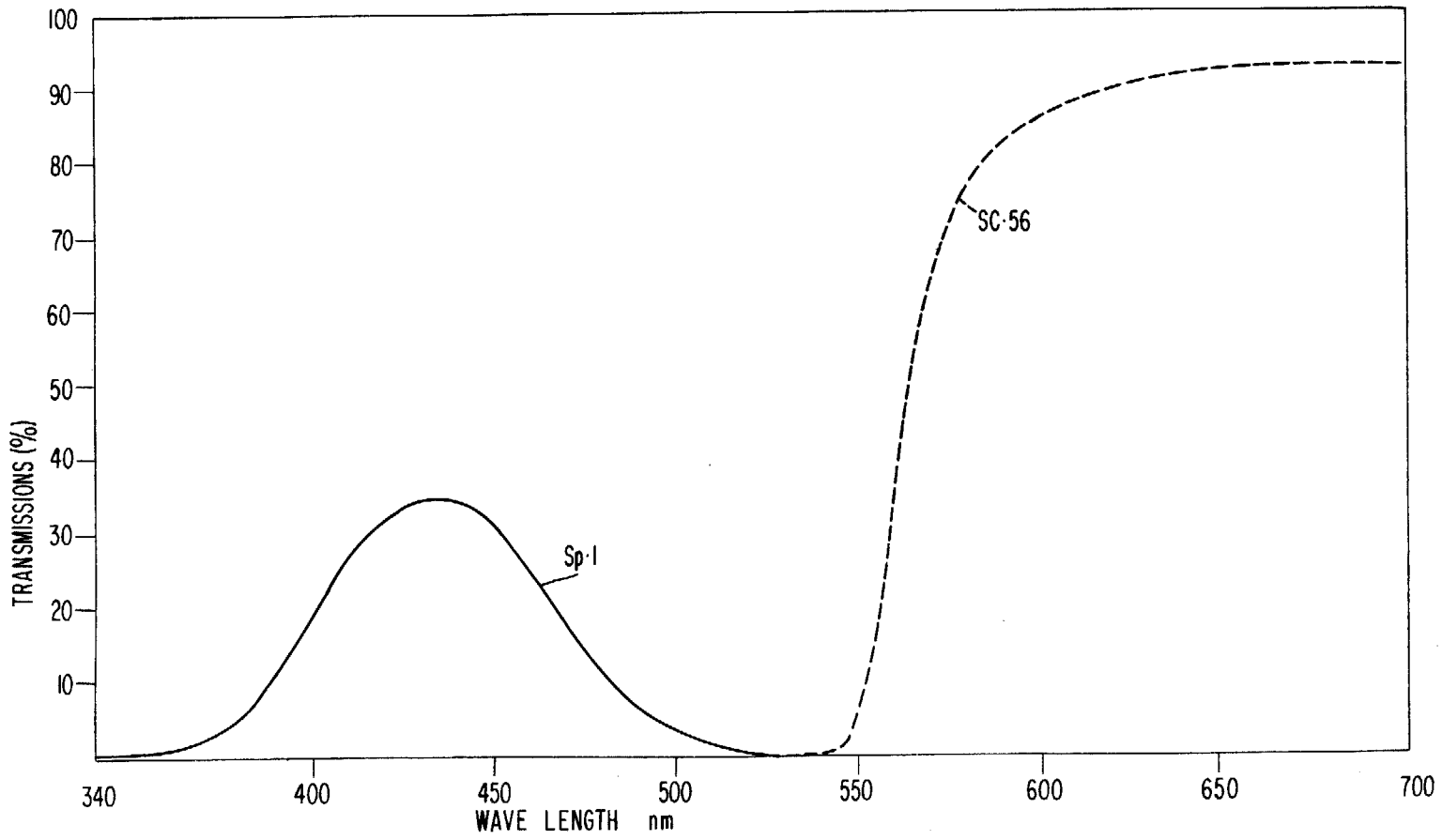
FIG. 6 shows the spectral percent transmission curves of the filters Sp-1 and Sc-56 used in the Example.

| Run No. | Sensitizing Dye and Amount Added ($\times 10^{-5}$ mol) | | | | | SR | SB | Fog | Residual Color** | Spectro-gram |
|---|---|---|---|---|---|---|---|---|---|---|
| 1 | | — | | — | | * | 100 | 0.05 | None | |
| | (I-A) | 2 | | — | | * | 96 | 0.05 | None | |
| | | 4 | | — | | * | 91 | 0.05 | None | |
| | | 8 | | — | | * | 87 | 0.06 | None | |
| | | — | (II-E) | 8 | | 100 | 100 | 0.05 | None | |
| | (I-A) | 4 | (II-E) | 8 | | 138 | 100 | 0.06 | None | |
| | | 8 | | 8 | | 144 | 100 | 0.06 | None | Fig. 1 |
| 2 | (I-E) | 2 | | — | | * | 96 | 0.05 | None | |
| | | 4 | | — | | * | 96 | 0.05 | None | |
| | | 8 | | — | | * | 87 | 0.05 | None | |
| | (I-E) | 4 | (II-E) | 8 | | 120 | 87 | 0.06 | None | |
| | | 8 | | 8 | | 120 | 87 | 0.06 | None | |
| 3 | | — | (II-A) | 8 | | 125 | 91 | 0.05 | None | |
| | (I-A) | 2 | (II-A) | 8 | | 165 | 100 | 0.06 | None | |
| | | 4 | | 8 | | 172 | 100 | 0.06 | None | Fig. 2 |
| 4 | (I-A) | 2 | (II-A) | 8 | (A)2 | 222 | 87 | 0.07 | Slight | Fig. 3 |
| | | — | | 8 | 2 | 214 | 91 | 0.07 | Slight | |
| 5 | (I-B) | 2 | | — | | * | 100 | 0.05 | None | |
| | | 4 | | — | | * | 96 | 0.05 | None | |
| | | 8 | | — | | * | 91 | 0.05 | None | |
| | (I-B) | 2 | (II-A) | 8 | | 150 | 96 | 0.06 | None | |
| | | 4 | | 8 | | 165 | 96 | 0.06 | | |
| 6 | | — | (II-H) | 8 | | 157 | 81 | 0.05 | None | |
| | (I-D) | 2 | | — | | * | 96 | 0.05 | None | |
| | | 4 | | — | | * | 90 | 0.05 | None | |
| | | 8 | | — | | * | 87 | 0.05 | None | |
| | (I-D) | 2 | (II-H) | 8 | | 180 | 90 | 0.05 | None | |
| | | 4 | | 8 | | 180 | 90 | 0.06 | None | |
| | | 8 | | 8 | | 172 | 90 | 0.06 | None | Fig. 4 |
| 7 | (I-D) | 4 | (II-H) | 8 | (C)2 | 208 | 87 | 0.07 | Slight | |
| | | — | | 8 | 2 | 200 | 87 | 0.07 | Slight | |
| 8 | | — | (II-I) | 8 | — | 125 | 90 | 0.06 | None | |
| | (I-D) | 2 | | 8 | — | 140 | 84 | 0.06 | None | |
| | | 4 | | 8 | — | 144 | 84 | 0.06 | None | |
| 9 | | — | (II-I) | 8 | — | 120 | 76 | 0.06 | None | |
| | (I-D) | 2 | (II-I) | 8 | — | 144 | 90 | 0.06 | None | |
| | | 4 | | 8 | — | 144 | 90 | 0.06 | None | |
| | | 8 | | 8 | — | 144 | 93 | 0.06 | None | Fig. 5 |

*The values were too low to be measured.
**Little>Slight>None

Table 2

| Sensitizing Dyes and Amount Added (× $10^{-5}$mol) | | | | S 580 | Fog |
|---|---|---|---|---|---|
| | — | (II-E) | 8 | 100 | 0.05 |
| (I-A) | 2 | | — | * | 0.05 |
| | 4 | | — | * | 0.05 |
| | 8 | | — | * | 0.06 |
| (I-A) | 2 | (II-E) | 8 | 100 | 0.06 |
| | 4 | | 8 | 123 | 0.06 |
| | 8 | | 8 | 130 | 0.06 |

*Same as the footnote to Table 1.

Table 3

| Sensitizing Dyes and Amount Added (× $10^{-5}$mol) | | | | S 580 | Fog |
|---|---|---|---|---|---|
| | — | (II-A) | 8 | 100 | 0.05 |
| (I-A) | 2 | (II-A) | 8 | 115 | 0.06 |
| | 4 | | 8 | 132 | 0.06 |
| | 8 | | 8 | 135 | 0.06 |

Table 4

| Sensitizing Dyes and Amount Added (× $10^{-5}$ mol) | | | | S 580 | Fog |
|---|---|---|---|---|---|
| | — | (II-H) | 8 | 100 | 0.05 |
| (I-D) | 2 | | — | * | 0.05 |
| | 4 | | — | * | 0.05 |
| | 8 | | — | * | 0.05 |
| (I-D) | 2 | (II-H) | 8 | 130 | 0.05 |
| | 4 | | 8 | 130 | 0.06 |
| | 8 | | 8 | 130 | 0.06 |

*Same as the footnote to Table 1.

Table 5

| Sensitizing Dyes and Amount Added (× $10^{-5}$ mol) | | | | S 580 | Fog |
|---|---|---|---|---|---|
| | — | (II-L) | 8 | 100 | 0.05 |
| (I-D) | 4 | (II-L) | 8 | 120 | 0.06 |
| | 8 | | 8 | 145 | 0.06 |

Table 6

| Sensitizing Dyes and Amount Added (× $10^{-5}$ mol) | | | | S 580 | Fog |
|---|---|---|---|---|---|
| | — | (II-I) | 8 | 100 | 0.05 |
| (I-D) | 2 | (II-I) | 8 | 126 | 0.05 |
| | 4 | | 8 | 142 | 0.06 |
| | 8 | | 8 | 152 | 0.06 |

Table 7

| Sensitizing Dyes and Amount Added (× $10^{-5}$ mol) | | | | S 580 | Fog |
|---|---|---|---|---|---|
| | — | (II-C) | 8 | 100 | 0.05 |
| (I-A) | 2 | (II-C) | 8 | 142 | 0.04 |
| | 4 | | 8 | 142 | 0.05 |
| | 8 | | 8 | 178 | 0.06 |

The results obtained and shown in Tables 1 to 7 above demonstrate the combinations of sensitizing dyes having supersensitizing effects in accordance with this invention provide excellent results. In other words, by using the sensitizing dyes of the general formula (I) which do not substantially spectrally sensitize in combination with the sensitizing dyes of the general formula (II), the sensitivity of the sensitizing dyes of the general formula (II) in the red wavelength region (up to about 630 nm) can be markedly increased. It can also be seen that in the red wavelength region, the monochromatic sensitivity of the sensitizing dyes at 580 nm on the shorter wavelength side is well increased.

The combination of sensitizing dyes having supersensitizing effects in accordance with this invention is useful for spectral sensitization of silver halide emulsions for red-sensitive layers of color photographic materials, such as color negative photographic materials or color reversal photographic materials, silver halide emulsions for photographic materials for the graphic arts, and silver halide emulsions used for photographic materials to be subjected to microsecond exposure, especially CRT photographic materials or photographic materials for holography, or photographic materials used in facsimile systems.

When the photographic emulsion of this invention is used for color photographic materials, it is preferred to provide a magenta or red external filter above, or adjacent, the red-sensitive silver halide emulsion layer obtained by the present invention in order to reduce the green sensitivity of the emulsion as compared with the red senstivity of the emulsion. In order to form this filter layer, the dyes disclosed, for example, in Japanese Patent Publications Nos. 18459/66, 13168/68, 3504/68, and 22069/64, Japanese Patent Applications No. 98474/71, U.S. Pat. Nos. 3,440,051, 3,282,699, 3,468,883, 3,294,539, 3,379,533 3,352,680, 3,389,994, 3,384,487, 3,423,207, 3,493,375, 3,486,897, 3,481,927, 3,497,502, 3,540,887, 3,573,289, 3,560,214, 3,615,432 and 3,615,546, and British Patent No. 506,385 can be used. In particular, dyes which selectively absorb light of wavelengths shorter than 570 nm are useful. Furthermore, the processes disclosed in U.S. Pat. Nos. 3,425,834, 3,469,987, 3,455,693, 3,392,022, 3,282,699, 3,672,898, 3,502,474, 3,512,983, 3,594,171, and 3,445,231, and Belgian Patent No. 627,308 can be used. These dyes can also be used in order to prevent irradiation or halation.

While the invention has been described in detail and with reference to specific embodiments thereof, it will be apparent to one skilled in the art that various changes and modifications can be made therein without departing from the spirit and scope thereof.

What is claimed is:

1. A silver halide photographic emulsion containing, in combination, supersensitizing amounts of at least one supersensitizing dye of the following general formula (I)

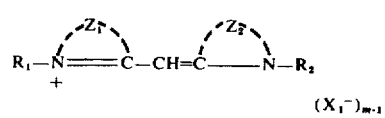

wherein $Z_1$ and $Z_2$ each represents an atomic group required to form a 2-quinoline ring; $R_1$ and $R_2$ each represents an aliphatic group, with at least one of $R_1$ and $R_2$ being a hydroxyalkyl group, an alkyl group containing a carboxyl group or an alkyl group containing a sulfo group; $X_1$ is an acid anion; and *m* is 1 or 2 and when $m$ is 1 the dye forms an intramolecular salt and at least one sensitizing dye of the following general formula

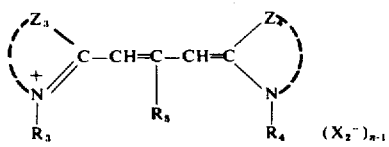

wherein $Z_3$ represents an atomic group required to form a benzimidazole ring substituted in at least one of the 5- and 6-position with a chlorine atom or a benzoxazole ring unsubstituted at the 5-position or substituted at the 5-position with a methyl group, an ethyl group, a methoxy group, a phenyl group or a chlorine atom; $Z_4$ represents an atomic group required to form a benzothiazole or benzoselenazole ring unsubstituted at the 5-position or substituted at the 5-position with a chlorine atom or a methyl group, an ethyl group, a methoxy group or a phenyl group; $R_3$ and $R_4$ each represents an aliphatic group with at least one of $R_3$ and $R_4$ being an alkyl group containing a carboxyl group, a hydroxyalkyl group or an alkyl group containing a sulfo group; $R_5$ represents a hydrogen atom or an alkyl group; $X_2$ is an acid amine group; and $n$ is 1 or 2, and when $n$ is 1, the dye forms an intramolecular salt.

2. The silver halide photographic emulsion of claim 1, wherein the molar ratio of the sensitizing dye of the general formula (II) to the sensitizing dye of the general formula (I) is 1:10 to 1:1.

3. The silver halide photographic emulsion of claim 1, wherein the heterocyclic ring formed by $Z_1$ and $Z_2$ is a 2-quinoline ring unsubstituted at the 6-position or substituted at the 6-position with a methyl group, an ethyl group, a methoxy group or a chlorine atom, and at least one of $R_1$ and $R_2$ is a sulfoalkyl group or carboxyalkyl group.

4. The silver halide photographic emulsion of claim 1, wherein at least one of $R_3$ and $R_4$ is a sulfoalkyl group or carboxyalkyl group.

5. The silver halide photographic emulsion of claim 1, wherein the heterocyclic ring formed by $Z_1$ and $Z_2$ is a 2-quinoline ring unsubstituted at the 6-position or substituted at the 6-position with a methyl group, an ethyl group, a methoxy group or a chlorine atom, at least one of $R_1$ and $R_2$ is a sulfoalkyl group or carboxyalkyl group, the heterocyclic ring formed by $Z_3$ is a benzimidazole ring substituted at at least one of the 5- and 6-positions with a chlorine atom; the heterocyclic ring formed by $Z_4$ is a benzothiazole ring or a benzoselenazole ring unsubstituted at the 5-position or substituted at the 5-position with a chlorine atom or a methyl group, an ethyl group, a methoxy group or a phenyl group; and $R_5$ is a hydrogen atom.

6. The silver halide photographic emulsion of claim 1, wherein the heterocyclic ring formed by $Z_1$ and $Z_2$ is a 2-quinoline ring unsubstituted at the 6-position or substituted at the 6-position with a methyl group, an ethyl group, a methoxy group or a chlorine atom, at least one of $R_1$ and $R_2$ is a sulfoalkyl group or carboxyalkyl group, the heterocyclic ring formed by $Z_3$ is a benzoxazole ring unsubstituted at the 5-position or substituted at the 5-position with a methyl group, an ethyl group, a methoxy group, a phenyl group or a chlorine atom; and $R_5$ is an ethyl group.

7. A photographic material comprising a support having thereon the silver halide photographic emulsion of claim 1.

* * * * *